United States Patent [19]

Rake

[11] Patent Number: 4,757,993

[45] Date of Patent: Jul. 19, 1988

[54] EXERCISE DEVICES WITH AN ADJUSTABLE LEVER ARM

[76] Inventor: Paul L. Rake, 210 Mott St., Trenton, N.J. 08611

[21] Appl. No.: 70,736

[22] Filed: Jul. 7, 1987

Related U.S. Application Data

[63] Continuation-in-part of Ser. No. 797,829, Nov. 14, 1985, abandoned, and a continuation-in-part of Ser. No. 830,770, Feb. 19, 1986, abandoned, and a continuation-in-part of Ser. No. 833,339, Feb. 26, 1986, abandoned.

[51] Int. Cl.[4] ..... A63B 21/02

[52] U.S. Cl. ..... 272/142; 272/72; 272/130; 272/134; 272/DIG. 4

[58] Field of Search ..... 272/72, 117, 130, 134, 272/136, 142, 143, DIG. 4

[56] References Cited

U.S. PATENT DOCUMENTS

| | | | |
|---|---|---|---|
| 3,398,953 | 8/1968 | Thompson | 272/142 X |
| 3,638,941 | 2/1972 | Kulkens | 272/142 X |
| 3,708,167 | 1/1973 | Potgieter | 272/134 X |
| 3,902,717 | 9/1975 | Kulkens | 272/134 |
| 3,904,196 | 9/1975 | Berlin | 272/72 |
| 4,157,179 | 6/1979 | Ecklor, Jr. | 272/136 X |
| 4,226,415 | 10/1980 | Wright | 272/134 X |
| 4,254,950 | 3/1981 | Baumann | 272/134 X |
| 4,452,448 | 6/1984 | Ausherman | 272/72 X |
| 4,582,320 | 4/1986 | Shaw | 272/134 X |
| 4,602,780 | 7/1986 | Gall | 272/130 X |
| 4,603,857 | 8/1986 | Chipman et al. | 272/142 X |
| 4,618,140 | 10/1986 | Brown | 272/72 |
| 4,634,115 | 1/1987 | Hawkins | 272/142 X |

FOREIGN PATENT DOCUMENTS

| | | | |
|---|---|---|---|
| 2241444 | 3/1974 | Fed. Rep. of Germany | 272/134 |
| 2245608 | 3/1974 | Fed. Rep. of Germany | 272/134 |
| 2335022 | 1/1975 | Fed. Rep. of Germany | 272/134 |
| 2659520 | 7/1978 | Fed. Rep. of Germany | 272/134 |

*Primary Examiner*—Richard J. Apley
*Assistant Examiner*—Robert W. Bahr
*Attorney, Agent, or Firm*—Alan M. Sack

[57] ABSTRACT

Exercise devices with an adjustable handle and lever arm are provided for exercising the major muscle groups individually against a selected resistance. The exercise devices include a frame with a base and a leg, and a lever support is pivotably attached at one end and is adjustably attached to the leg at the selected distance from the lever support pivot. An exercise handle with a handle lever is connected to the lever support at a handle lever pivot and a resistance lever is also pivotably connected to the lever support. By adjusting the attachment of the lever support to the leg, the lever pivots are placed at the desired height from the base. The resistance lever is connected to a resistance source by a flexible connector which transmits the resistance from the resistance source in the general direction originating from the lever support pivot to the resistance lever. An engagement pin selectively engages the connector to the resistance lever at specific points along the resistance lever to allow the user to select a particular resistance at the handle. Rotation of the resistance lever is opposed by a resistance transmitted along and parallel to the connector which acts on the resistance lever at the engagement pin. An additional connector fixes the desired angle between the resistance lever and the handle lever to transmit force between the levers.

30 Claims, 11 Drawing Sheets

U-1

U-2

1
2
3
4
5
6
7
8
9
12
14
15
17
18
20
21
22
23
24
26
28
29
32
33
34
35
36
37
38
39
40
41
42
43
44
45
46
47
49
50
51
52
57
59
79
81
98
99

EXERCISE DEVICES WITH AN ADJUSTABLE LEVER ARM

This is a continuation-in-part of copending patent application Ser. No. 797,829 filed on Nov. 14, 1985, now abanded, Ser. No. 830,770 filed on Feb. 19, 1986, now abandoned and Ser. No. 833,339 filed on Feb. 26, 1986, now abandoned by the same inventor.

BACKGROUND OF THE INVENTION

1. Field of the Invention

The present invention relates to an exercise devices with an adjustable handle and lever arm for exercising the major muscle groups, individually, against a selected resistance.

2. Background of the Related Art

The present invention relates generally to exercise devices which use one exercise handle and provides for a wide range of progressive resistance exercises, rowing, and variable incline board situps. In recent years there has been an increasing awareness of the physical and psychological benefits of regular physical exercise. With this increasing awareness has come a wide variety of strength and aerobic training devices for home use. Many of these units have a single source of selectable resistance which is connected by way of a number of different pulley-cable systems to different exercise aiding devices, such as handles, pull bars, straps and padded levers located at various positions on the unit.

Some multi-exercise units have attempted to circumvent the multiplicity of cable-pulley systems in exercising devices through the use of a single exercise handle which is adaptable to be used for different exercises. These devices are described in U.S. Pat. Nos. 248,121; 2,855,199; 3,000,632; 3,708,167; 4,226,415; 4,286,782; 4,339,125; 4,387,894; 4,407,496; 4,582,320; 4,614,338; and 4,616,825, copies of these references are attached.

Most of these devices with the exception of U.S. Pat. No. 4,582,320 and 4,226,415 are very limited in the variety and types of exercises which can be accommodated.

U.S. Pat. No. 4,582,320 issued to Shaw is a device which provides a wide range of exercises, however, it cannot exercise the hip and knee joints individually and it cannot provide a rowing exercise.

The device described in U.S. Pat. No. 4,226,415 issued to Wright is a versatile unit as well, however, it is limited to hydraulic resistance transmitted perpendicular to a resistance lever. The resistance handle cannot be adjusted in angle or direction to the lever arm and the exercise handle does not exert a continuous force in returning the to starting position. Resistance in both directions is an important part of an exercise cycle in terms of stimulating muscle growth and without such resistance progress is slowed. In addition, Wright's exercise unit does not provide for rowing exercises nor does it allow for inclined situps. In addition, the resistance in Wright is transmitted perpendicular to lever 72 along shaft 50. The amount of resistance can only be adjusted by varying the pressure of the hydraulic cylinder. Accordingly, a complex of gauges and pressure adjustments valves are required for the Wright device.

Accordingly, there is a need for exercise apparatus which can be used for a large variety of progressive weight resistance exercises, rowing and variable inclined situps in which the height of the exercise lever, the height of the pivot about which the exercise lever is moved and the angle and direction of the exercise lever may be easily adjusted without having to work against the force provided by the resistance source. Prior to the present invention no single exercise unit or the combination of known exercise units could provide of these benefits with simple, durable and cost effective exercise devices.

SUMMARY OF THE INVENTION

Exercise devices with an adjustable handle and lever arm are provided for exercising the major muscle groups individually against a selected resistance. The exercise devices include a frame with a base and a leg, and a lever support is pivotably attached to one end and is adjustably attached to the leg at a selected distance from the lever support pivot. An exercise handle with a handle lever is connected to the lever support at a handle lever pivot and a resistance lever is also pivotally connected to the lever support. By adjusting the attachment of the lever support to the leg, the lever pivots are placed at the desired height from the base. The resistance lever is connected to a resistance source by a flexible connector which transmits the resistance from the resistance source in the general direction originating from the support pivot to the resistance lever. An engagement pin selectively engages the flexible connector to the resistance lever at specific points along the resistance lever to allow the user to select a particular resistance at the handle. Rotation of the resistance lever is opposed by a resistance transmitted along and parallel to the flexible connector which acts on the resistance lever at the engagement pin. An additional connector fixes the desired angle between the resistance lever and the handle lever to transmit force between the levers. A board at the base of the exercise device is used to position the user for certain weight resistance exercises, for sit-ups and to provide a track for a rolling seat which is used for rowing exercises. On some embodiments of this invention a backrest and a footrest are also provided.

DESCRIPTION OF THE PREFERRED EMBODIMENT

EXAMPLE 1

Figures 1, 2, 4, 9, 12:
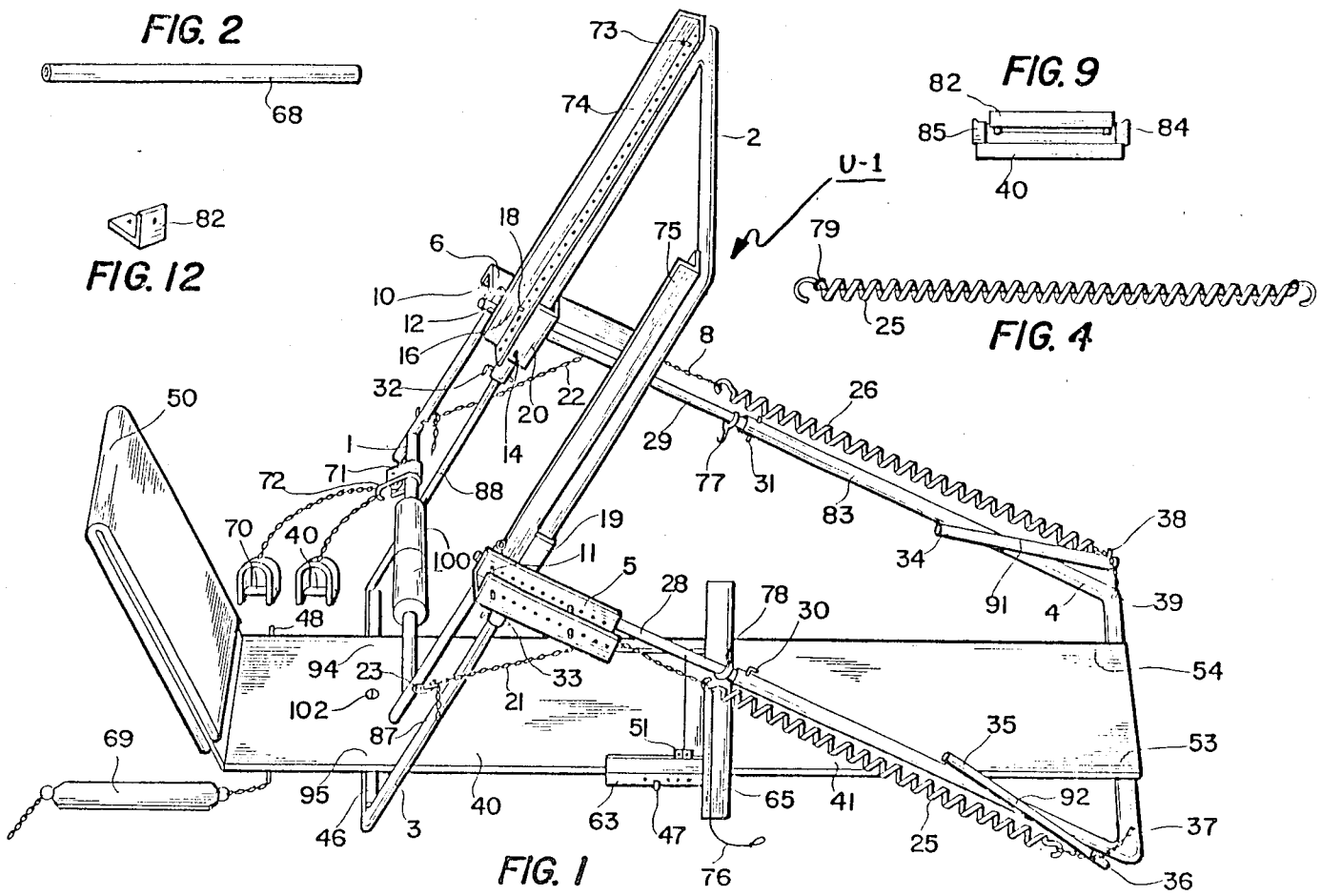
FIG. 1 is a perspective view of a first preferred embodiment of the present invention U1.
FIG. 2 illustrates a pipe segment 68 used along with the embodiment of the present invention shown in FIG. 1.
FIG. 4 illustrates the spring resistance means of the present invention shown in FIG. 1.
FIG. 9 is a front elevational view of the baseboard and the rolling seat illustrated in FIG. 7.
FIG. 12 is a perspective view of an angle piece illustrated in FIG. 11.

FIG. 1 shows a perspective view of one preferred embodiment of the exercise device of the present invention, designated as U1 which includes a single exercise handle 1 and a supporting framework mechanism. This unit U1 adapts to different exercises through changes in the exercise handle starting orientation, the exercise handle pivot height and the amount of resistance imported to the exercise handle 1.

The exercise handle 1 is an H-shaped component whose crossbar is grasped and pushed during the exercise cycle. Two segments of padding 25 and 100 provide cushioning when the handle crossbar is pushed.

Figures 3, 5, 6, 10, 11:
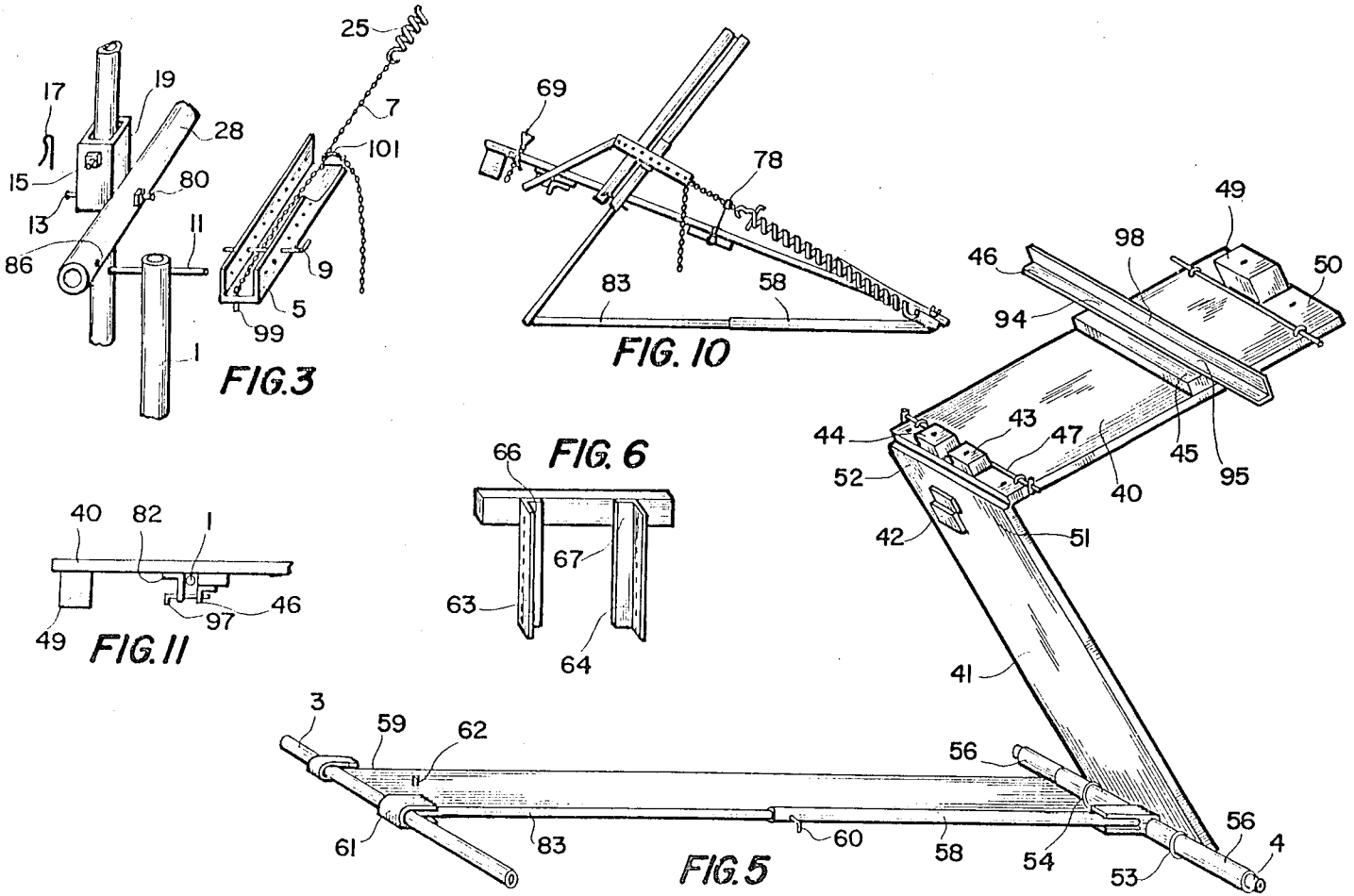
FIG. 3 is an enlarged exploded view of the handle lever pivot, positioning means and resistance lever of the embodiment of the present invention shown in FIG. 1.
FIG. 5 is a perspective view of the bench illustrating the foundation strut and the underside of the base board of the embodiment of the present invention shown in FIG. 1.
FIG. 6 is a perspective view of the rowing exercise footrest of the embodiment shown in FIG. 1.
FIG. 10 is a side elevational view of the embodiment of the present invention shown in FIG. 1 set up for inclined board sit-ups.
FIG. 11 shows an enlarged partial cut away view of the side of the baseboard illustrated in FIG. 10 with part of the exercise handle cut away.

In FIG. 3, a portion of pivot axle 11 passes through one end of the exercise handle 1 and is held by spot welds. An identical portion of pivot axle 12 passes through the other end of the exercise handle in a similar fashion as is illustrated in FIG. 1. The inward portion of pivot axle 11 passes through a hole in the lever support which includes pipe segment 28, illustrated as FIGS. 1 and 3. The inward end of pivot axle 12 passes through a similar hole in lever supporting pipe segment 29. These pivot axles act as pivoting means permitting the exercise handle 1 to be swung in a circular arc during the exercises.

The lever supporting pipe segments 28 and 29 in FIG. 1, extend into U-shaped frame part 4 and are fastened to it with pins 30 and 31. A square bracket 19 is attached to lever supporting pipe segment 28 and another square bracket 20 is attached to lever supporting pipe segment 29. These brackets are slidably attached to the legs of the rectangular frame designated as legs 2 and 3. Bolt 13 shown in FIG. 3 and bolt 14 shown in FIG. 1 pass between the inside wall of their respective brackets and in front of legs 2 and 3, respectively.

Brackets 19 and 20 are postionable at any number of predetermined distances from the ground by placing pegs 15 and 16 through holes in angle irons 75 and 74 and locking the pegs 15, 16 with pins 17 and 18, respectively. This adjustable feature of the exercise handle pivot height accommodates a multitude of difficult exercises. As can be seen in FIG. 3, resistance lever 5 pivots at the opposite end of pivot axle 11 from bracket 19. As shown in FIG. 1, an identical resistance lever 6 with an inverted orientation to resistance lever 5 pivots on pivot axle 12, on the other side of the exercise unit U1.

As shown in FIG. 1, resistance lever 5 is connected to the lever portion of handle 1 by chain 21 and hook 23. Likewise, resistance lever 6 is connected to the lever portion of handle 1 by chain 22 and hook 24. These chains fix the angle between the resistance levers 5, 6 and the lever portion of handle 1. Chains 21 and 23 attach to their respective resistance levers by rings 101 which pass through the resistance levers, as can be seen in FIG. 3. Hooks 23 and 24 are S-shaped hooks with one closed end. The closed end of hooks 23, 24 are placed over a bolt on exercise handle 1 and are kept from sliding off the bolt by a washer which sits between the loop of the closed end of the S-shaped hook and the head of the bolt.

Flexible connectors couple the resistance springs 25 and 26 to the resistance levers 5 and 6. As shown in FIGS. 1 and 3, chain 7 attaches at one end to spring 25 and at the other end to resistance lever 5, at bolt 99. Similarly, chain 8 connects spring 26 and resistance lever 6.

Both resistance levers 5 and 6 operate in the same manner as described in detail in reference to FIG. 3. Resistance lever 5 has a series of sets of holes along its length and a pin 9 which fits through any selected set of holes and over chain 7. Whenever the free end of the resistance lever 5 is swung downward by chain 21, it acts as a lever with a length equal to the distance between pivot axle 11 and pin 9. If pin 9 is moved farther from pivot axle 11, the effective length of the resistance lever becomes larger. Accordingly, more force will be needed to rotate the resistance lever about pivot axle 11. If, however, the resistance lever 5 is swung upwards it acts as a fixed length lever having its maximum length and the maximum force will be needed to rotate the resistance lever about pivot axle 11.

The links in chain 21 are preferably short enough so that each setting of pin 9 adjusts the effective length of resistance lever 5 to a different length. Otherwise, two adjacent pin settings could produce equal effective length resistance levers, resulting in the same effective resistance. Alternatively, a nylon strap could be used instead of a chain to completely eliminate this problem.

The springs 25 and 26 are prestretched to provide approximately 100 lbs. of initial resistance at the handle 1. The resistance of the springs increases as the springs are stretched. With a spring constant of 3 lb./inch and a maximum adjusted lever length of one foot, the initial resistance of 100 lbs. will increase to approximately 135 lbs. when lever 1 is rotated through a 90 degree arc. This increase in resistance does not present a problem to the user since most muscle groups actually get stronger in the 90 degree region of the exercise cycle.

If both resistance levers are attached to the exercise handle 1 by chains 21 and 22 while the lever portion of the exercise handle 1 is at the 6 o'clock position, as illustrated in FIG. 1, and exercise handle 1 is rotated clockwise, then resistance lever 6 will provide its maximum resistance setting and resistance lever 5 will provide anywhere from zero to its maximum resistance setting, depending on the location of pin 9. If the maximum resistance setting of resistance lever 5 is 100 lbs., and pin 9 is placed through the midpoint of resistance lever 5, then 50 lbs. of resistance will be transmitted to exercise handle 1 through chain 21. In addition, 100 lbs. of resistance will be transmitted through chain 22 to exercise handle 1 from resistance lever 5 at its fixed maximum length. Accordingly, the combined, total resistance at the exercise handle 1 will be 150 lbs. By moving pin 9 along resistance lever 5 the resistance at exercise handle 1 can be adjusted to vary between 100 and 200 lbs. If a resistance between 0 to 100 lbs. is desired, chain 22 can be disconnected from hook 24, so that only resistance lever 5 remains connected to exercise handle 1 for selecting the desired resistance.

If the user desires to rotate the exercise handle starting at the 12:00 o'clock position in a counter-clockwise direction during a particular exercise, then chains 21 and 22 are first disconnected, then the handle is moved to the 12:00 o'clock position and each chain in swung around its connection point on its respective resistance lever and reconnected to the exercise handle lever. In this setting the role of the resistance levers is reversed. Resistance lever 6 now provides 100 lbs of resistance and resistance lever 5 may be adjusted to provide a range varying between 0–100 lbs. The reversal of roles of the resistance levers when the exercise handle is repositioned from the 12:00 o'clock to the 6:00 o'clock position and vice-a-versa results in even wear of the springs, so that no one spring is always required to provide 100 lbs. of resistance and always be maximally stretched.

Preferably, a rope 79, as shown in FIG. 4, is placed through the middle of each spring with one end hooked to the end of the spring and the other end connected to the opposite end of the spring and to an anchor bolt which holds that end of the spring. As illustrated in FIG. 1, spring 26 is connected to anchor bolt 38 and spring 25 is connected to the anchor bolt 36. These ropes serve as safety devices which will stop the forward progress of a spring before it can reach and harm the user should the spring break during an exercise. The rope is placed inside and through the spring rather than outside the spring so that once the spring is stopped its rear end does not catapault toward the user.

In FIG. 1 two additional levers as shown at the rear of exercise unit U1. Lever 34 pivots about bolt 91 and lever 35 pivots about bolt 92. Each of these bolts passes through lever support frame 4 which anchors these levers. The back portion of spring 25 is attached to a bolt on lever 36 by a chain segment which also hooks over bolt 37 on lever support frame 4. This chain segment is attached to support frame 4 by a cottor pin which passes through a hole in bolt 37. This chain segment attaches spring 25 to the end of lever 35 and attaches lever 35 to the back of support frame 4, thereby holding the end of spring 25 in place. The arrangement is the same for lever 34 and spring 26.

These levers are used to prestretch the springs before the exercise unit U1 is used. The initial tension of the typical garage door springs, as illustrated in FIG. 1, is approximately 30 lbs. Accordingly, each spring must be prestretched to provide 100 lbs. of tension before they can be used in this exercise unit U1 and provide a combined maximum adjustable resistance of 200 lbs. Pipe segment 68, illustrated in FIG. 2, is used to increase the leverage of levers 34, 35 by sliding it over the end of the respective lever 34 or 35, opposite to the end which the spring is attached. By using pipe segment 68 to move lever 34 or 35, thereby stretching spring 25 or 26 until the chain segment can be attached to its respective holding bolt 37 or 39. To loosen the springs these steps are reversed. The spring prestretching levers can also be used to substitute stronger springs should the user require a greater range of resistance than possible with the original springs.

FIG. 1 shows board 40 which is hinged to an equal length board 41. Attached to the front end of board 40 is padding 50 which when unfolded covers nearly the entire length of boards 40 and 41. The base board 40 and 41 is hinged in the middle so that it can be folded in half when unit U1 is folded, and collapsed for storage.

FIG. 5 illustrates the structure underneath the boards 40, 41. Pipe 83 slides into pipe 58 and is connected with a pin 60. Telescoping pipes 58 and 83 act as a spacing strut to maintain the distance between the base of the front square frame portion including U-shaped frame section 2 and Peg section 3 and the base portion of the lever support u-shaped frame section 4 and pipe lengths 28 and 29, as shown in FIGS. 1 and 5. Bracket 61 holds the bottom of U-shaped frame leg section 3 against pipe segment 83 with bolt 62. Bracket 61 permits the cross pipe on the frame leg section 3 to rotate as the geometry of the triangular frame changes when the height of the exercise handle pivots are moved along frame leg section 3. Bracket 57 at the other end of the spacing strut serves the same role with respect to the U-shaped lever support frame section 4. Cable 59 prevents pipe 83 from being pulled out of pipe 58 when pin 60 is removed. Pipe segment 58 is centered on the cross bar of lever support section 4 by two plastic tubes 55 and 56. Board 41 is attached to the crosspiece of lever support frame section 4 with brackets 53 and 54 which wrap around plastic tubes 55 and 56.

If board 40 is folded back over board 41 and the folded two board unit is lowered, then bracket 42 will come in contact with the telescoping spacing strut consisting of pieces 83 and 58. Brackets 53 and 54 are loose enough so that board 41 may be slid side ways across the cross bar of each support frame section 4, so that the bottom portion of bracket 42 fits under pipe 58 to hold board 41 against the spacing strut 83, 58. If board 40 is unfolded and laid flat against pipe 83, then blocks 44 and 43 will trap pipe 83 between them to prevent brackets 42 from moving away from spacing strut 83, 58, and hold board 41 in place. Board 40 is held down by positioning hole 93 over bolt 62, and by fastening board 40 to the telescoping frame 83, 58 by fastening a wing nut 102 or bolt 52, as illustrated in FIG. 1, into the large hole in board 40. Wing nut 102 rests on board 45 which is bolted to board 40 with bolts 94 and 95. In addition bolts 94, 95 hold angle iron 46 against boards 40 and 45. Angle iron 46 centers board 40 on the base portion of frame leg 3. Board 45 is a spacer which elevates the front of board 40 and acts in conjunction with spacer block 49. Elevation of board 40 provides enough room for the user's elbows during the bench press exercises illustrated in FIG. 23.

Exercise unit U1 can be compacted by collapsing of a number of its major structural components. U-shaped lever support frame 4 accommodates pipes 28 and 29 which telescopically slide into its ends. When extended, pipes 28 and 29 reach approximately ¾ of their length into the ends lever support frame 4 and are held there by pins 30 and 31. When fully collapsed pipes 28 and 29 can be slid all the way into lever support frame 4 thereby reducing its length to about 3.5'. Pins 30, 31 are easily removed when the spring tension is released by releasing levers 34 and 35.

The front frame piece, which consists of U-shaped frame portion 3 telescopically slides into U-shaped leg frame portion 2 to form a large rectangle, it collapses to the length of frame portion 2 when pins 32 and 33 are removed. This length is also approximately 3.4'. The angle irons 74 and 75 are approximately 3.5' long so the total collapsed height of the front rectangular frame's leg portions 2, 3 and attached angle irons 74, 75 is about 3.5'. The spacing strut 83, 58 likewise telescopes its collapsed length, when pin 60 is removed is the length of pipe 58, which is about 3.5'.

The baseboard is about 7 feet long, made up of boards 40 and 41 which are hinged together by hinges 51 and 52. When it is disconnected from foundation strut 83 and 58 and folded, its length is about 3.5'.

Because no structural component is longer than about 3.5', the entire exercise unit U1 is collapsible to 3.5'. Referring to FIG. 1, the steps in collapsing this unit U1 are: Disconnect front and middle of the baseboard and fold in half. Lower the exercise handle brackets 19 and 20 to rest against pins 32 and 33 and hold in place with angle irons 75 and 73. Loosen springs 25 and 26 using levers 34 and 35. Take out pins 30 and 31 allowing the front rectangular frame's leg which include U-shaped pipes 2 and 3 to be folded backward to the ground. Then remove pins 33 and 32 on the front frame portion and pin 60 from pipes 58, 83 to fold and telescopically collapse the unit U1 to approximately 3.5' in length. To set up this unit U1 these steps are followed in reverse order.

Figure 7:
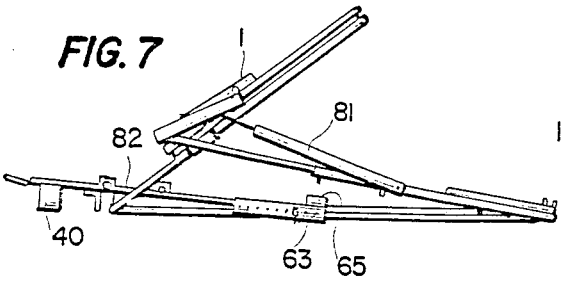
FIG. 7 is a side elevational view of the embodiment of the present invention shown in FIG. 1 as adapted for rowing exercises.
Figure 8:
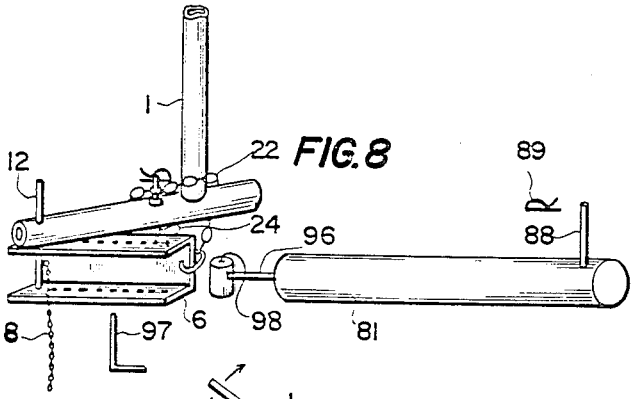
FIG. 8 is an enlarged view showing attachment of the piston in FIG. 7.

FIGS. 7, 8 and 9 show details of unit U1 when it is being used as a rowing machine. The exercise handle 1 is lowered so that its pivot is about 1' from board 40, as shown in FIG. 7. This changes the unit's U1 geometry so that the front frame's legs portion 2 and 3 lean toward the back of the unit U1 and exercise handle 1 can be moved in an arc from the 9 o'clock to the 2 o'clock position. After spring 26 is removed, pneumatic piston 81 is hooked to exercise handle 1 at resistance lever 6. Pneumatic piston 81 has valves which provide resistance, here the flexible connector 8 is replaced by rod 96. FIG. 8 illustrates how resistance lever 6 is connected to exercise handle 1.

The piston rod 96 can be attached to the resistance lever 6 at any selected distance from the pivot axle 12 by moving the hole 97 in rod 96 into alignment with the holes in lever 6, and holding rod 96 in place with pin 98. The resistance at the exercise handle 1 is determined by the piston's resistance and by the distance between this connection point and axle 12. The other end of the piston is attached to the frame by inserting peg 88 through hole 83 of lever support frame 4, and by fixing peg 88 in hole 83 with cotter pin 89.

FIGS. 7 and 9 illustrate the rowing seat 82 on exercise unit U1, it includes four wheels. Each set of 2 wheels is attached to an axle which is held to the bottom of the seat 82 with axle clamps. The wheeled seat 82 is placed on board 40, and because these wheels have lip portions they are maintained in a track on board 40.

FIGS. 1, 6 and 7 illustrate the foot rest 65 which is used during the rowing exercises. Footrest 65 is used to provide a comfortable bend in the legs when rolling seat 82 FIG. 7 is at its right most position on baseboard 40. To position the footrest, angle irons 63 and 64 which are attached to the cross piece 65 with bolts 66 and 67 and are spread apart so that the angle irons separate from axle 47. Once removed from axle 47, crossbar 65 is moved to the desired position and the angle irons are pushed together so that the ends of the axle pass through holes in the angle irons. Cotter pins are then placed through holes in the ends of the axle to secure the foot rest. The user sits on the wheeled seat 82, grasps the exercise handle 1, and places his feet on the foot rest 65 to begin the rowing exercise.

FIG. 10 illustrates the configuration of exercise unit U1 set up for sit ups. Hinged boards 40 and 41 are disconnected from telescoping base struts 83 and 58. Then the cross bar of exercise handle 1 is placed underneath the board 40, 41 and held there with bracket 82, shown in FIG. 12, which is attached to the bottom of board 40, as illustrated in FIG. 11. Pin 97 passes through bracket 82 and through hole 98 in angle iron 46, to hold the exercise handle 1 in place. Since boards 41 and 40 are hinged, they must be supported by a cable to provide a flat sit up surface. Cable 76, showin in FIG. 1, is routed through pipe 68 which is placed under boards 40 and 41, then cable 76 is attached to hook 77. Strap 69 holds the user's feet in place during the sit-up exercises. Strap 69 attaches to axle 48 with two pins, as illustrated in FIGS. 1 and 10, through holes drilled in the ends of the axle.

The inclination of the sit up board is changed by raising and lowering the height of the pivots of exercise handle 1. For most sit-up exercises U-shaped frame leg 2, is connected to frame leg 3 by way of holes 87 and 88 which are 1' from the ground. In this position, the front end of the sit up board can be raised from about 0 to 3.5' above the ground. If more inclination is needed, the frame's leg 2 can be raised another foot to the position illustrated in FIG. 1.

Figure 13:
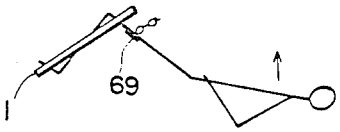
FIGS. 13–24 schematically illustrate the position of the pivots and the handle lever of the exercise devices of the present invention set up for a variety of exercises with the user illustrated as a stick figure.

Bent knee sit ups can also be accomplished as shown in FIG. 13. To set up for bent knee sit-ups, strap 69, is disconnected from the front of board 40. The chain on one end of this strap is placed over the end of bolt 13 which has passed through pipe segment 28 and a cotter pin is placed through the hole in bolt 13 to hold the chain in place. The chain on the other end of the strap is attached to the counterpart bolt 14 on the other side of the exercise unit U1. Both pins are attached to strap 69, as illustrated in FIG. 1. The knees are placed over this strap and the feet under the cross bar of exercise handle 1. Handle cushions 25 and 100 are separated in order to cushion the user's ankles.

The major weight resistance exercises possible on this device are shown in FIGS. 14–24. Other exercise are possible, and largely depend on the user's imagination. The exercises illustrated in FIGS. 13–24 benefit most of the major muscle groups. These exercises are done either kneeling, laying down, sitting or standing on the bench board. When standing, the cushioning 50 is laid in front of the board so that it is not soiled.

Figure 14:
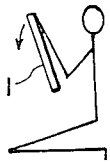
Figure 23:
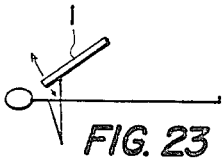
Figure 20:
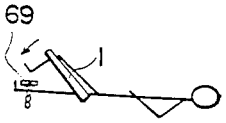

Arrows indicate the motion of the handle during the exercise, double arrows indicate two different exercises each in an opposition direction. FIGS. 14, 16 and 23 show the user grasping the cross bar of the exercise handle 1 on both sides of the cushions which have been pushed together. The remaining FIGS., with the exception of FIG. 15 show the user pushing against the cusions on the exercise handle 1 with various parts of the body.

Figure 15:
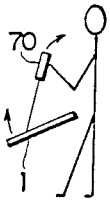
Figure 16:
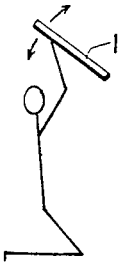
Figure 17:
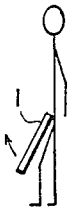
Figure 18:
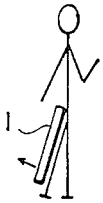
Figure 19:
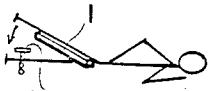

In FIG. 15, accessory handles 70 and 90 are used to minimize the chances of the user being hit by the cross bar of exercise handle 1 in the unlikely event of spring breakage. The accessory handles 70 and 90 are attached with two chains to hook 72 which is bolted between the ends of a bracket 72 which encircles the cross bar of exercise handle 1. Bracket 72 is loosely fitting so that it may rotate on the exercise handle cross bar as the user performs the exercise of FIG. 15.

In FIG. 16, the exercise handle 1 is grasped on the cross bar when the user is pushing the handle up and is grasped on the parts of the handle which stick out beyond the cross bar when it is being pulled down. This placement of the hands during the downward exercise allows the cross bar to pass in front of the head rather than behind it where it could come in contact with the neck.

In FIG. 19, 21, 22 and 24, the strap 59 is used to hold the user's body in place.

Figure 22:
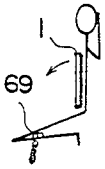

FIG. 22 illustrates an alternative to the inclined sit-ups. This exercise uses springs instead of gravity to strengthen abdominal muscles.

Figure 21:
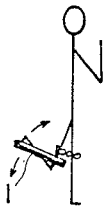
Figure 24:
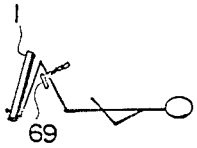

FIG. 24 is the same exercise as the downward arrow exercise in FIG. 21 except both knees are exercised at once. In FIG. 21, only one knee can be exercised at one time since the user is standing.

EXAMPLE #2

Figure 25:
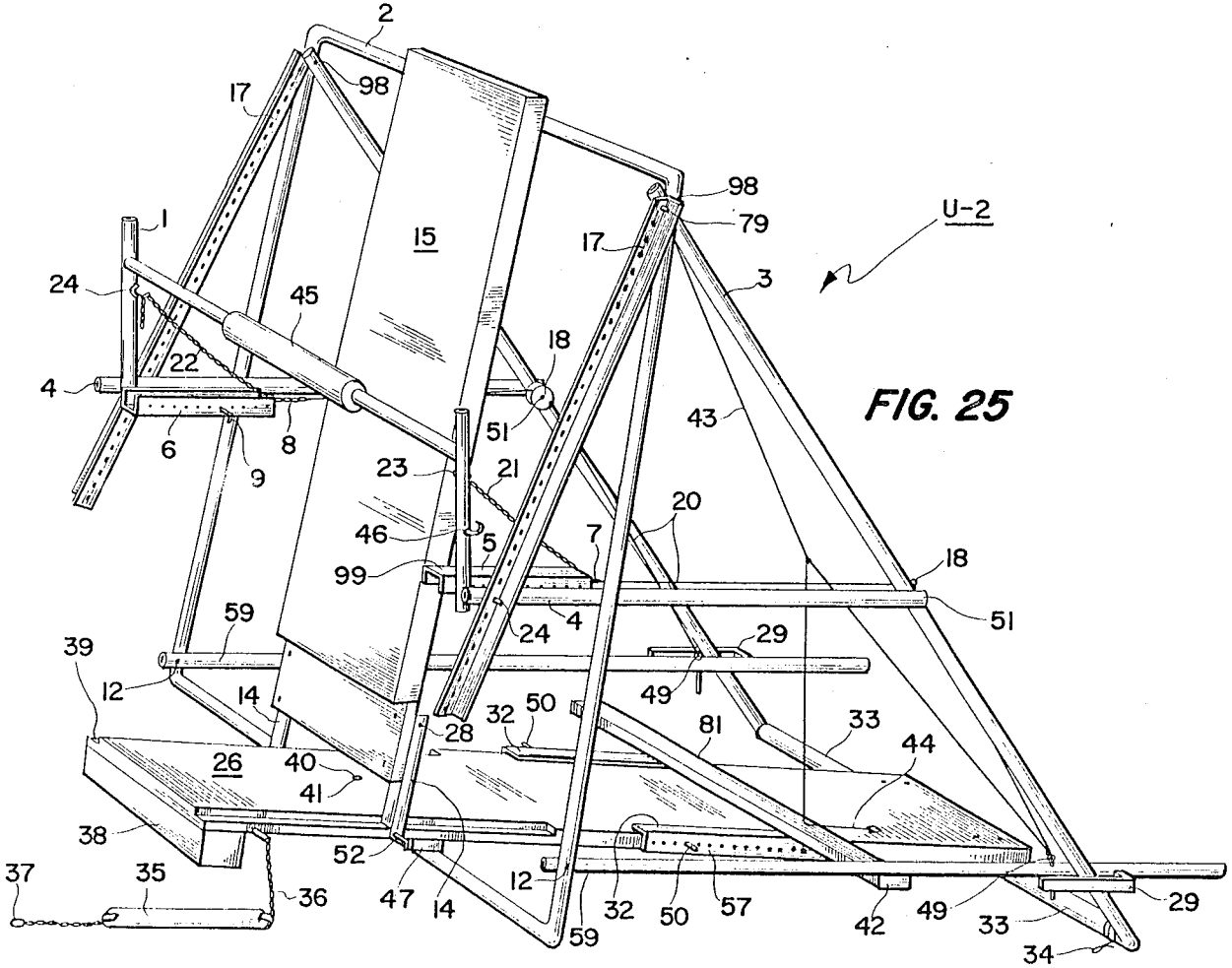
FIG. 25 is a perspective view of a second preferred embodiment of the present invention U2.

FIG. 25 is a perspective view of another embodiment of the present invention, designated as exercise unit U2. Exercise unit U2 has the overall shape of a triangle, the front leg of the triangle includes a rectangular frame leg 2 to which is attached a u-shaped frame piece 3 which forms the rear leg of the triangle. These two frame parts are attached to each other at their uppermost ends with bolts 98. Joining these two frame pieces at their bases is pipe 70, illustrated in FIG. 33 as shown in FIG. 3A, pipe 70 is attached to the base of u-shaped frame piece 3 by a bracket 75 which encircles frame piece 3 and attached to pipe 70 with a bolt 76. Bracket 75 is centered on the cross member of frame piece 3 by two plastic tubes 33 centering the end of pipe 70, the other end of pipe 70 attaches to the base of rectangular frame leg 2 with a bolt 72 which passes through pipe 70 and holds pipe 70 with a cotter pin 50 which passes through a small hole in the bolt. Spacer 71 is bolted to the end of pipe 70 with a bolt 60.

The exercise handle is the H-shaped component 1, as described previously. Padding 45 is used to provide cushioning when needed during specific exercises.

The outside end of each pivoting axle segment 30, illustrated in FIG. 25, passes through a hole in the end of each lever supporting arm 4 and are held in place by an axle cap or cotter pin. These axle pivots 30 allow the exercise handle 1 to be swung in a circular arc.

Bolts 51 hold the ends of lever support arms 4 to frame piece 3 and extend through the sides of frame piece 3 to hold pulleys 18. Lever support arms 4 pivot about the attachment bolts 51 allowing the exercise handle 1 at the opposite end of lever support arms 4 to be raised or lowered. Once positioned at the desired height, the exercise handle 1 is fixed in place by aligning a hole in each perforated angle irons 17 over pivots axles 24 which pass through lever support arms 4. Angle irons 17 are held in place at their uppermost ends with bolts 79 which pass through rectangular frame legs 2.

Figure 26:
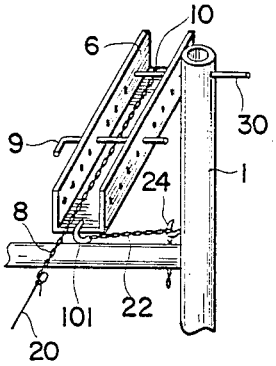
FIG. 26 is a perspective view of the handle lever pivot and resistance lever of the embodiment of the present invention illustrated in FIG. 25.

The resistance lever of exercise unit U2 is shown in detail in FIG. 26, and is the same as the resistance lever described in detail with regard to exercise unit U1. In this unit U2, the chain 8 is connected to cable 20 which extends between chain 8 coupled to resistance lever 6 and eyebolt 49, passing over pulley 18 located at the pivot point of lever supporting arm 4. Eyebolt 49 connects cable 20 to a weight bearing lever arm 59 which pivots about bolt 12 at the base of rectangular frame 2. Bracket 29 guides the motion of the weight bearing lever arms 59. The force of the weight on weight bearing lever arm 59 is directed through cable 20 over pulley 18 to the resistance levers 5 and 6. Weight plates (not shown) are attached at the ends of weight bearing lever arms 59.

Pulley 18 illustrated in FIG. 25 is mounted on or about the pivot point of lever supporting arm 4 so that the supporting arm can be raised or lowered without having to disconnect cable 20 from the resistance lever 5 or 6. If the pulley is mounted slightly higher than the pivots of lever supporting arm 4, then cable 20 will exert an upward force on the front of lever support arms 4 and thereby make the repositioning of the pivots of exercise handle easier.

The resistance system described above is duplicated on the other side of exercise unit U2. The resistance lever 5 on this side has an upside down orientation with respect to resistance lever 6, in the same manner described with regard to exercise unit U1.

In addition, an alternative method of resistance selection is possible because of the use of weight plates. Instead of, or in addition to varying the effective length of the resistance levers, as previously described, the resistance selection pins 9 can be set and the amount of weight on resistance bearing levers 59 can be varied.

Figure 29:
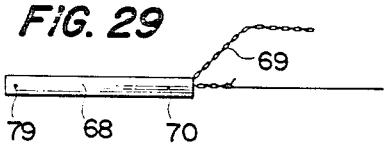
FIG. 29 is a side elevational view of a non-adjustable resistance lever for use in the exercise unit illustrated in FIG. 25.

FIG. 29 illustrates a fixed length resistance lever 68 which can be used in place of resistance levers 5 and 6, its operation is identical to that of resistance levers 5 or 6 when they are used at their maximum effective length. Fixed length resistance lever 68 including a pipe with a pivot hole 79 and a chain segment 69 which is attached to the pipe with a bolt 70. Chain segment 69 is connected to cable 20 at one end, and runs through the pipe of fixed length resistance lever 68, and hooks to bolt 70. Chain 69 then doubles back through the pipe and also serves as a connecting chain, vis-a-vis chains 21 or 22, illustrated in FIG. 25.

Since the fixed length lever works the same when rotated both clockwise or counterclockwise only one resistance lever is needed to provide resistance to the exercise handle in both directions. However, using only one resistance lever 68 places all the resistance on one side of the exercise handle 1 which would tend to distort the handle unless it were extremely strong. Therefore, it is more desirable to provide two of these resistance levers 68 where one provides a fixed resistance and the other a variable resistance, which is varied by changing the number of weight plates on resistance bearing lever 59.

Figure 27:
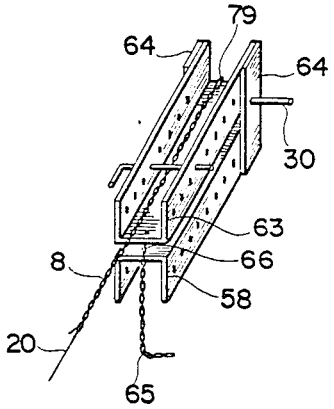
FIG. 27 is a perspective view of an alternative double resistance lever.
Figure 28:
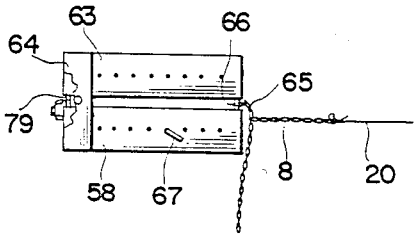
FIG. 28 is an elevational, partial cut away view of the double resistance lever illustrated in FIG. 27.

FIG. 27 illustrates a more complicated version of the resistance lever of FIG. 26. This double resistance lever can be located on either side of exercise unit U2 or U1. This double resistance lever is constructed by connecting two long u-shaped brackets 58 and 63 back-to-back with a space between then for pivot axle 30. Pivot axle 30 passes through a hole in plates 64 which in turn are connected to u-shaped brackets 58 and 63 to keep these brackets in the back-to-back orientation. As seen in the partial cut away view in FIG. 28, chain 8 fits between the ends of either bracket 58 or 63 is held by a bolt 79 which fits through bracket 58, through a link in chain 59 and then through bracket 63. Chain 65 fits between the two brackets 58 and 63, and is attached to the brackets by bolt 66. Chains 8 and 65 serve the same roles as chains 8 and 22, FIG. 26 and as previously described with regard to exercise unit U1.

The resistance levers illustrated in FIGS. 26, 27 and 29 may be used in combination or apart depending on the desired characteristics. Also, the use of any of these resistance levers will provide varying resistance insomuch as the force required to move the resistance lever through an arc during an exercise cycle will vary depending on its position in the cycle. This variation is due to the change in angle between the resistance lever and the connecting cable 20. As the resistance lever is moved through 180 degree of arc, resistance begins at a minimal value, climbs to a maximum value at about 90 degree of arc mark and falls off again as it continues to rotate to 180 degrees.

This resistance curve is advantageous, since skeletal muscles tend to be stronger at certain points of the exercise cycle where this unit presents a greater resistance and weaker at those points where this unit presents a lesser resistance. This matching of resistance to strength is generally considered to provide a more thorough workout and has been incorporated in a number of other commercially available units.

Figure 34:
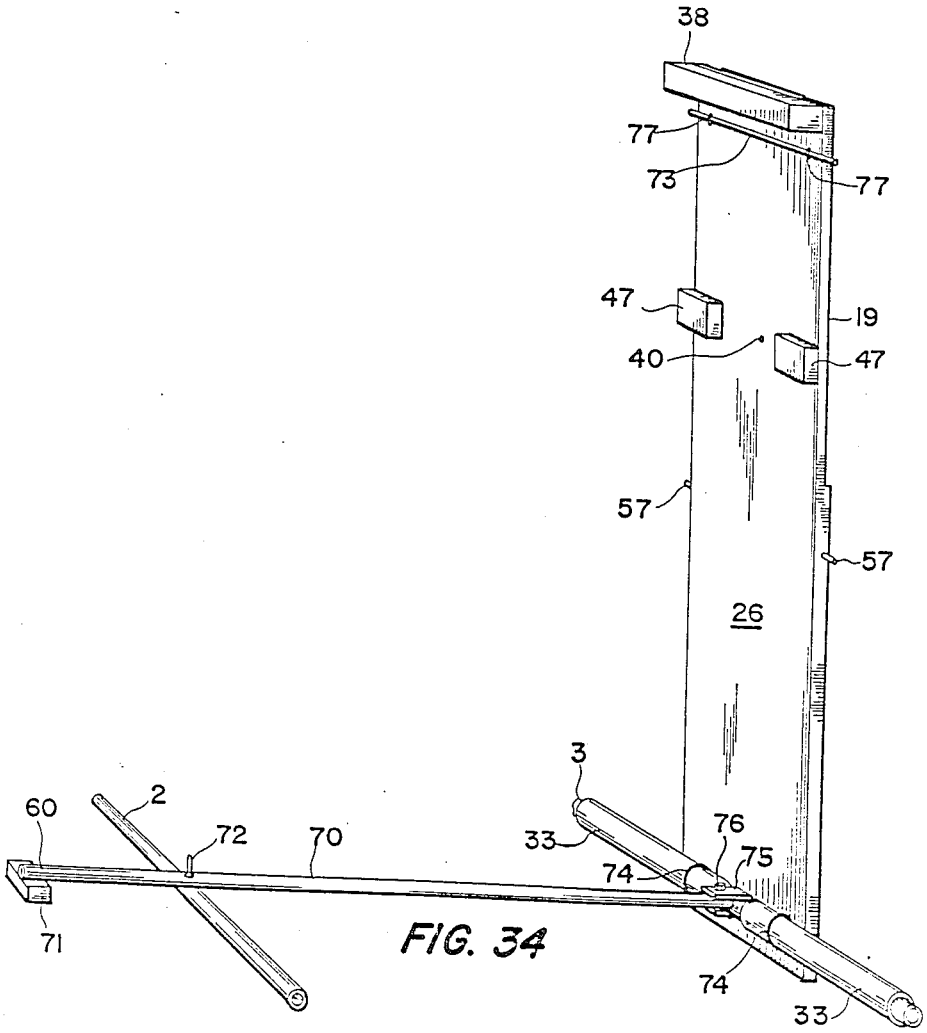
FIG. 34 is a perspective view of the bench, illustrating the foundation strut and the wider side of the base board of the embodiment of the present invention illustrated in FIG. 29.

At the base of exercise unit U2 is a base board 26. As seen in FIG. 34, base board 34 attaches to the cross piece of u-shaped frame 3 by pipe brackets 74 which encircle and clamp on to plastic pipe segments 33. The front end of base board 26 includes two blocks 47 which make contact with the bottom cross piece of rectangular frame leg 2 when the base board is in the down position. These blocks serve to elevate the front end of base board 26. Block 38 at the end of base board 26 serves as a spacer between base board 26 and the ground.

Bolt 72 fits through hole 40 on base board 26 when the board is in the down position. Hole 40 tapers outwards toward the top surface of base board 26 so that a wing nut 41 can be placed on bolt 72 and screwed down into the base board 26 so that the wing nut 41 does not protrude from the surface of base board 26.

Pegs 57 are used to mount the foot rest 81 for rowing as is illustrated in FIG. 25. Axle 73 which is mounted to base board 26 with axle brackets 77 is used for attaching the strap 35 in FIG. 25 to base board 26 by chains 36 and 37.

The backboard 15, illustrated in FIG. 25, is constructed of a board covered with padding and attached to two lengths of angle iron 14 of which is bolted to base board 15 with two bolts. Angle irons 14 have a cut out section which allows a part of them to extend beyond the top of base board 26. Each extension of the angle iron 14 has a hole through which a pin 52 passes into a hole 19 in base board 26 to hold the base of the backboard 15 in place and preventing side-to-side sway.

Figure 30:
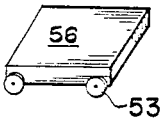
FIGS. 30, 31 and 32 are isometric views of a rolling rowing seal for use with the exercise unit of the present invention.
Figure 31:
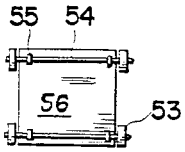
Figure 32:
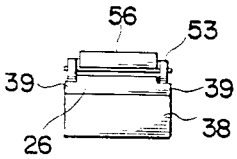

FIGS. 30, 31 and 32 show details of a rowing seat including a seat board 56; wheels 53; axles 54 and axle brackets 54. FIG. 32 shows how this seat is positioned on indentations 39 in base board 26 for rowing.

Weight training exercises as well as rowing and inclined sit ups are performed as discussed in Example 1.

Figure 33:
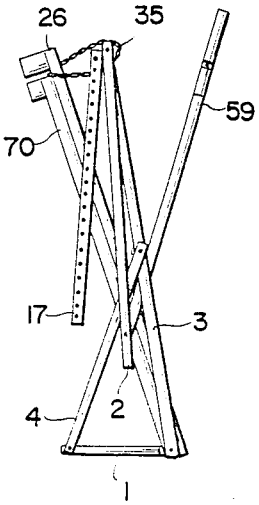
FIG. 33 is a side elevational view of the exercise unit of the present invention illustrated in FIG. 25, folded for storage.

As illsutrated in FIG. 33, when not in use exercise unit U2 can be folded to take less floor space. In this configuration exercise unit U2 is free standing. Lever supporting arms 4 act as struts to hold the exercise unit U2 up. These lever support arms 4 are in turn held in place by exercise handle 1 which is attached to the base of u-shaped frame piece 3 by rope and loop section 35. Rope and loop section 35 is tied at one end to u-shaped frame piece 3 and hooked to exercise handle 1 by hook 23. The base board 26 and spacing strut 70 are held to the top of rectangular frame leg 2 by strap 35 which wraps around the strut 70, the base board 26 and the top cross piece of frame 2 hooking onto itself. The weight bearing resistance levers 59 rest against the wall behind the unit.

EXAMPLE 3

Figure 35:
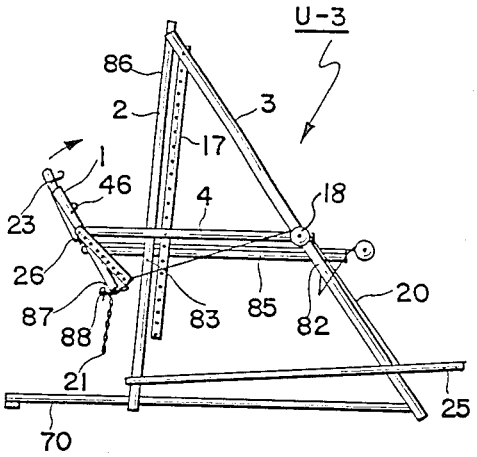
FIG. 35 is a side elevational view of a third preferred embodiment of the present invention, U3.
Figure 36:
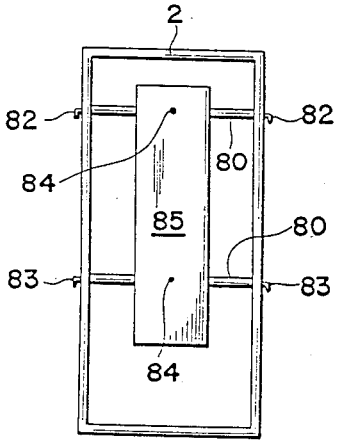
FIG. 36 is a top plan view of the embodiment of the present invention, illustrated in FIG. 35.
Figure 37:
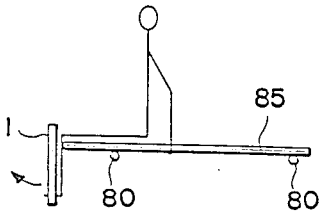
FIG. 37 is a side elevational partial cut away view of the embodiment of the present invention illustrated in FIG. 35.

The exercise unit in U3 according to the present invention, illustrated in FIGS. 35 and 36 is another version of exercise devices U1 and U2. Lever support arms 4 as well as other elements of the resistance system are mounted differently than exercise unit U2, excercise handle 1 is more elongated, and backboard 15 of FIG. 25 has been replaced by backboard 85. The perforated angle irons 17, are now placed behind frame leg 2 rather than in front of it as in exercise unit U2. These changes allow leg extension exercises to be performed while sitting down, as illustrated in FIG. 37, and for leg curl exercises to be performed while lying down, as illustrated in FIG. 34.

In FIG. 35 the backboard 85 is illustrated in a horizontal position and in FIG. 36 it is illustrated in a vertical position. Backboard 85 is attached to cross pipes 80 with bolts 84. The cross pipes 80 are in turn held in place on frame leg 2 with pins 82 and 83. Each of these pins passes through frame leg 2 and into the ends of pipes 80. The backboard 85 is moved to the horizontal position shown in FIG. 37 by removing pins 82, swinging the backboard down to the horizontal position and attaching pipe 80 to u-shaped frame 3 with pins 82, as is illustrated in FIG. 35.

EXAMPLE 4

Figure 38:
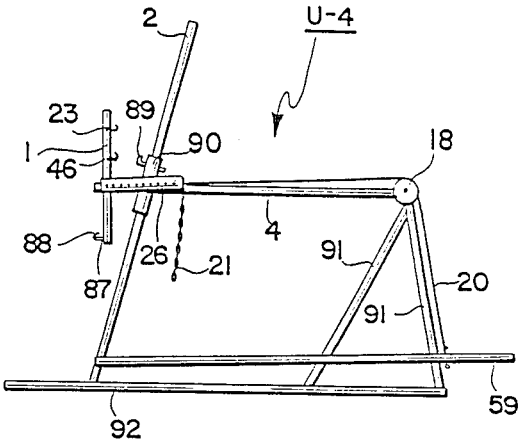
FIG. 38 is a side elevational view of a fourth preferred embodiment of the present invention, U4.
Figure 39:
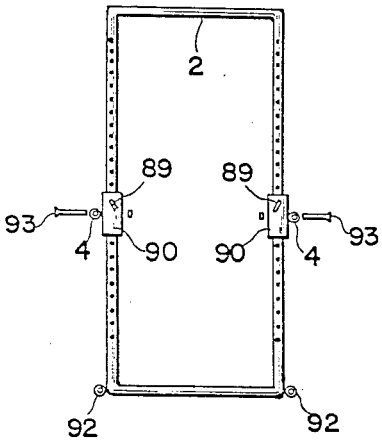
FIG. 39 is a front elevational, partial exploded view of the embodiment of the present invention illustrated in FIG. 38.

FIG. 38 illustrates exercise unit U4 which is another alternative version of the exercise units of the present invention. Exercise unit U4 uses the same lever supporting arms 4 and the same resistance systems as exercise devices previously discussed. However, the geometry of supporting framework is quite different than exercise units U1 through U3.

In this unit, brackets 90 are attached to the free ends of support lever arms 4 with pivot bolts 93. Lever support arms 4 and bolts 93 are used in conjunction with pins 89 to adjust the height of the exercise handle assembly from the base 92 of the frame which rests on the ground. Pins 89 lock brackets 90 in place by sliding through apertures in the front of bracket 90, through frame legs 2 and back through bracket 90.

Figure 40:
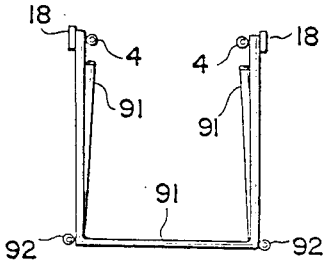
FIG. 40 is a rear elevational view of the rear portion of the frame of the embodiment of the present invention in FIG. 38.

As may be seen in FIGS. 38 and 40, the two u-shaped frame pieces 91 are connected together to form a triangular support structure which holds the pivoting ends of lever support arms 4 and pulleys 18. This triangular supporting structure is attached to rectangular frame legs 2 with base frame pipes 92.

EXAMPLE 5

Figure 41:
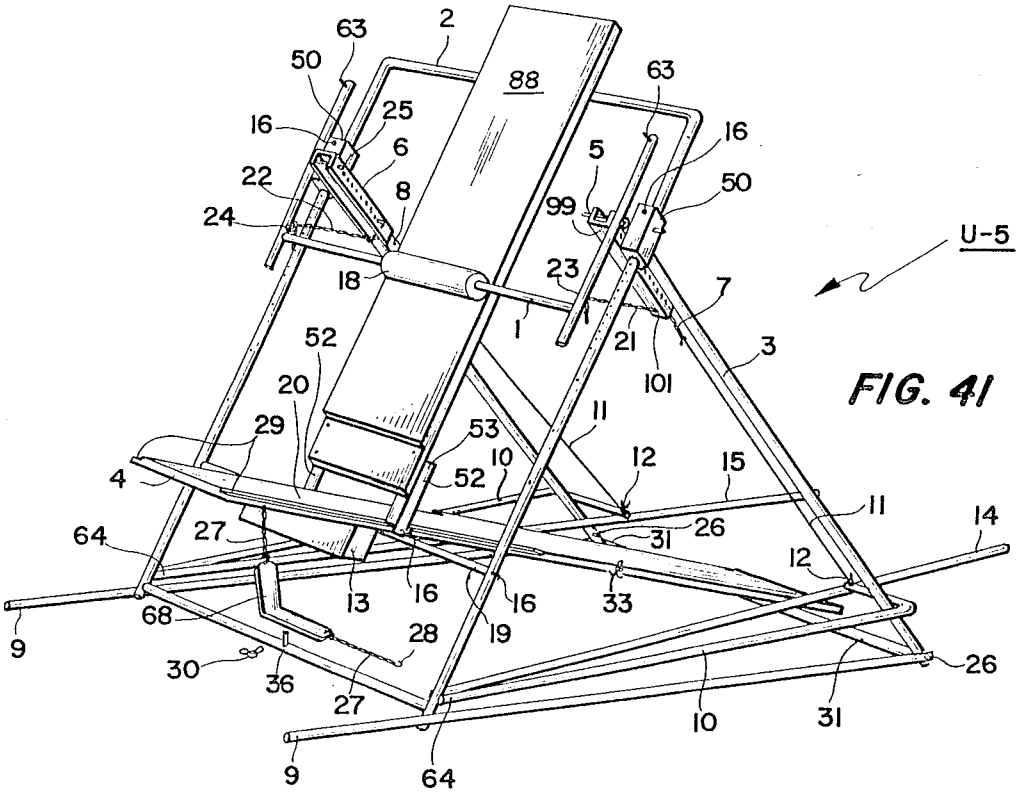
FIG. 41 is a perspective view of a fifth preferred embodiment of the present invention, U5.
Figure 42:
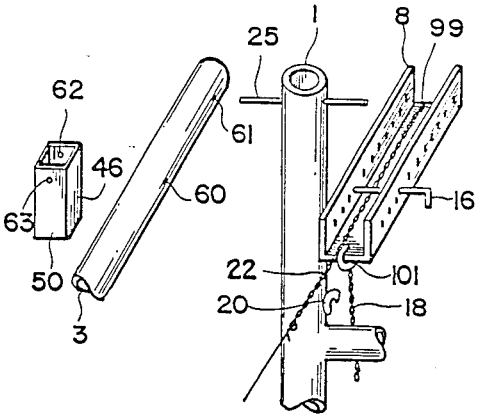
FIG. 42 is an enlarged exploded view of the handle lever pivot, positioning menas and resistance lever of the embodiment of the present invention illustrated in FIG. 41.
Figure 43:
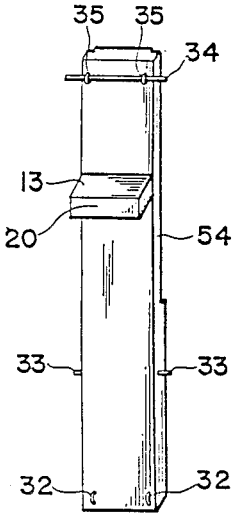
FIG. 43 is a bottom plan view of the bench of the embodiment of the present invention illustrated in FIG. 41.
Figure 44:
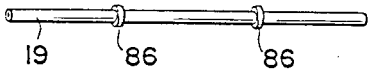
FIG. 44 is the bar used to support the benches of FIG. 43 in the manner illustrated in FIG. 41.

FIG. 41 illustrates another embodiment of the exercise unit according to the present invention U5. Most of the components of exercise unit U5 are the same as previously described for exercise units U1 through U4.

U-shaped lever support arms 3, illustrated in FIG. 41, are formed by a single pipe bent into a u-shape. Attached to the two ends of lever frame support arms 3 are two rectangular brackets 50. Brackets 50 slide up and down the sides of rectangular frame legs 2 and are used to lock the ends of lever support arms 3 at selected heights along frame legs 2 in order to adjust the distance between the base board 9 which is on the ground and exercise handle axle pivots 25. Brackets 50 are maintained at the desired height by pins 16. Pind 16 pass through holes 62 in brackets 50, and through one of the holes in rectangular frame leg 2. A pivot bolt is placed through holes 60 in the ends of the u-shaped lever support arms 3 and through holes 46 in brackets 50.

The base of the rectangular frame leg 2 is attached to the base of the u-shaped lever support arms 3 by base frame 9. Base frame 9 is attached to the bases of u-shaped lever support arms 3 and rectangular frame legs 2 with bolts 26. Bolts 26 allow lever support arms 3 and rectangular frame legs 2 to pivot when the geometry of the triangular frame of this excercise unit U5 changes when the height of the pivots 25 of exercise handle 1 are moved. Chains 7 and 16 couple resistance levers 6 and 8, respectively, by cables 11 to weight bearing arms 14 and 15. Weight bearing arms 14 and 15 attach to cables 11 by eyehooks 12.

Weight bearing arms 14 and 15 are held to lever support arms 3 by motion guides 10. Eyebolts 12 serve the dual purpose of attaching cables 11 to weight bearing arms 14 and 15 as well as attaching motion guides 10 to weight bearing arms 14 and 15.

The shape of motion guides 10 allows the weight bearing arms 14 and 15 to come together enough to bring eyebolts 12 into near alignment with the points of brackets 5 and 6 where chains 7 and 8 connect. This arrangement reduces the friction between these guides and the sides of the u-shaped lever support arms 3. The alignment is a near alignment, the distance between the eyebolts is a bit wider than the distance between those ends of chains 7 and 8 which are connected to the resistance levers 5 and 6. This misalignment creates a force component on weight bearing arms 14 and 15 which pushes them toward each other and prevents unstable side-to-side sway as they are raised and lowered during an exercise.

Resistance is provided to the weight bearing arms 14 and 15 lever systems on both sides of exercise unit U5 by placing weight plates on weight bearing arms 14 and 15. Resistance is selected in the same manner as it is selected on the exercise devices discussed in the prior Examples.

The resistance system of exercise unit U5 has two important characteristics which should be noted. First, cables 11 attach to weight bearing arms 14 and 15 at a point located close to the pivots of u-shaped lever support arms 3. This allows the inclination of lever support arms 3 to be adjustable without any significant lifting or lowering of weight bearing arms 14 and 15. The connections of cables 11 to weight bearing arms 14 and 15 are slightly above and beyond the pivots of u-shaped lever support arms 3. When weight is placed on the ends of weight bearing arms 14 and 15, cables 11 tend to pull the moving ends of u-shaped lever support arms 3 slightly upward, thereby to some extent, counteracting the weight of these components and making the repositioning of the pivots of the exercise handle assembly much easier when changing exercises.

Second, as the pivots of the exercise handle assembly are raised and lowered the angle between cables 11 and weight bearing arms 14 and 15 is changed. As the pivot of the exercise handle moves closer to the ground this angle gets smaller and the component of force acting on weight bearing arms 14 and 15 is reduced. Accordingly, more force is needed to lift weight bearing arms 14 and 15 when the pivots of exercise handle 1 are close to the ground. Consequently, the pivots of the exercise handle cannot be moved too close to the ground because the resistance becomes too great. Therefore, on some exercises the baseboard 4 is moved up to a raised position as shown in FIG. 41 and held in place with pipe 19 and pins 7. When the baseboard 4 is in a lowered position, hole 20 in block 13 is lowered over bolt 36 and held in place with wing nut 30, as described with regard to unit U4.

The backboard 88 is constructed in the same manner as the backboard of exercise unit U4.

When not in use exercise unit U5 can be folded against a wall to save floor space. To fold, the weight plates are removed from the ends of weight bearing arms 14 and 15. Then the exercise handle 1 is raised and bolts 26 at the front of the exercise unit are removed. The base of rectangular frame leg 2 is then moved toward the base of the u-shaped lever support arms 3. At the same time, weight bearing arms 14 and 15 are raised up against rectangular frame legs 2 and the unit is tilted back against the wall with base pipes 9 swung upward against the wall.

I claim:

1. An exercise device for exercising against a resistance, comprising:

(a) a frame having a base and a leg connected to the base;

(b) handle means for exercising against said resistance including a handle lever fixed to said handle means;

(c) lever supporting means connecting said handle lever to said frame;

(d) handle lever pivoting means pivotally connecting said handle lever to said lever supporting means;

(e) resistance means for providing a source of said resistance;

(f) resistance lever for providing a predetermined resistance at said handle means;

(g) resistance lever pivoting means for pivotally connecting said resistance lever to said lever supporting means;

(h) resistance connective means connecting said resistance means to the resistance lever for transmitting a resistance from the resistance means to the resistance lever;

(i) engagement means for selectively engaging said resistance connective means to the resistance lever at a selected pivot point on the resistance lever to select a particular resistance at said handle means, so that rotation of the resistance lever about the resistance lever pivoting means requires a force having component perpendicular to the resistance lever, said rotation of the resistance lever is opposed by a resistance transmitted along and parallel to the resistance connective means which acts on the resistance lever at the selected pivot point of the engagement means;

(j) lever connecting means for fixing an angle between said resistance lever and said handle lever to transmit a component of a force perpendicular to the handle lever, from said handle lever to said resistance lever whereby said force urges rotation of said resistance lever about said resistance lever pivoting means; and, (k) positioning means for selectively fixing said lever supporting means, handle lever pivoting means and resistance lever pivoting means to said leg at a predetermined distance from said base of the frame without affecting the resistance at said handle means.

2. The exercise device recited in claim 1, wherein said resistance connective means includes a flexible connector.

3. The exercise device recited in claim 2, whereby said engagement means is adapted to engage said flexible connector at more than one predetermined pivot points along said resistance lever to selectively change the resistance at said handle means.

4. The exercise device recited in claim 3, wherein said lever connecting means comprises a variable connector for connecting said levers at more than one predetermined angle between said handle lever and said resistance lever.

5. The exercise device recited in claim 4 further comprising more than one resistance lever providing additional resistance at said handle means.

6. The exercise device recited in claim 5, whereby said resistance means comprises a biased resistance source.

7. The exercise device recited in claim 6, whereby said biased resistance source is a spring.

8. The exercise device recited in claim 7, wherein said resistance means includes a prestretching means.

9. The exercise device recited in claim 8, wherein said base includes a bench.

10. The apparatus recited in claim 9, wherein said bench includes a foot retaining means.

11. The exercise device recited in claim 10, whereby said frame is made from telescoping tubular members for collapsing said exercise device for storage.

12. An exercise device for exercising against a resistance, comprising:

(a) a frame having a base and a leg connected to the base;

(b) handle means for exercising against said resistance including a handle lever fixed to said handle means;

(c) lever supporting means connecting said handle lever to said frame;

(d) handle lever pivoting means pivotally connecting said handle lever to said lever supporting means;

(e) pneumatic resistance means for providing a source of said resistance;

(f) resistance lever for providing a predetermined resistance at said handle means;

(g) resistance lever pivoting means for pivotally connecting said resistance lever to said lever supporting means;

(h) resistance connective means connecting said resistance means to the resistance lever for transmitting a resistance from the pneumonic resistance means to the resistance lever;

(i) engagement means for selectively engaging said resistance connective means to the resistance lever at a selected pivot point on the resistance lever to select a particular resistance at said handle means so that rotation of the resistance lever about the resistance lever pivoting means requires a force having component perpendicular to the resistance lever, said rotation of the resistance lever is opposed by a resistance transmitted along and parallel tot he resistance connective means which acts on the resistance lever at the selected pivot point of the engagement means;

(j) lever connecting means for selectively fixing an angle between said resistance lever and said handle lever to transmit a component of a force perpendicular to the handle lever, from said handle lever to said resistance lever whereby said force urges rotation of said resistance lever about said resistance lever pivoting means; and, (k) positioning means for selectively fixing said lever supporting means, handle lever pivoting means and resistance lever pivoting means to said leg at a predetermined distance from said base of the frame without affecting the resistance at said handle means.

13. The apparatus recited in claim 12, whereby said resistance connective means includes a rigid connector.

14. The exercise device recited in claim 13, whereby said engagement means is adapted to engage said rigid connector at more than one predetermined pivot points along said resistance lever to selectively change the resistance at said handle means.

15. The exercise device recited in claim 14, wherein said lever connecting means comprises a variable connector for connecting said resistance levers at more than one predetermined angle between said handle lever and said resistance lever.

16. The exercise device recited in claim 15 further comprising more than one resistance lever providing additional resistance at said handle means.

17. The exercise device recited in claim 16, wherein said base includes a bench.

18. The exercise device recited in claim 17, whereby said bench includes a foot retaining means.

19. The exercise device recited in claim 18, whereby said bench further includes a rolling seat means.

20. The exercise device recited in claim 19, whereby said frame is made from telescoping tubular members for collapsing said exercise device for storage.

21. An exercise device for exercising against a resistance, comprising:

(a) a frame having a base and a leg connected to the base;

(b) handle means for exercising against said resistance including a handle lever fixed to said handle means;

(c) lever supporting means which at one end connects said handle lever to said frame and having a pivot at another end to pivotally connect said other end of said lever support means to said frame;

(d) handle lever pivoting means pivotally connecting said handle lever to said lever supporting means;

(e) resistance means for providing a source of said resistance;

(f) resistance lever for providing a predetermined resistance at said handle means;

(g) resistance lever pivoting means for pivotally connecting said resistance lever to said lever supporting means;

(h) a flexible resistance connective means connecting said resistance means to the resistance lever for transmitting a resistance from the resistance means to the resistance lever;

(i) engagement means for selectively engaging said resistance connective means to the resistance lever at a selected pivot point on the resistance lever to select a particular resistance at said handle means, so that rotation of the resistance lever about the resistance lever pivoting means requires a force having component perpendicular to the resistance lever, said rotation of the resistance lever is opposed by a resistance transmitted along and parallel to the resistance connective means originating from the direction of the pivot connecting said lever support means to said frame, said resistance acts on the resistance lever at the selected pivot point of the engagement means;

(j) lever connecting means for fixing an angle between said resistance lever and said handle lever to transmit a component of a force perpendicular to the handle lever, from said handle lever to said resistance lever whereby said force urges rotation of said resistance lever about said resistance lever pivoting means; and, (k) positioning means for selectively fixing said lever supporting means, handle lever pivoting means and resistance lever pivoting means to said leg at a predetermined distance from said base of the frame without affecting the resistance at said handle means.

22. The exercise device recited in claim 21, whereby said engagement means is adapted to engage said flexible connector at more than one predetermined pivot points along said resistance lever to selectively change the resistance at said handle means.

23. The exercise device recited in claim 22, wherein said lever connecting means comprises a variable connector for connecting said levers at more than one predetermined angle between said handle lever and said resistance lever.

24. The exercise device recited in claim 23 further comprising more than one resistance lever providing additional resistance at said handle means.

25. The exercise device recited in claim 24, whereby said resistance means comprises a biased resistance source.

26. The exercise device recited in claim 25, whereby said biased resistance source includes a weight connected to a weight bearing means attached to said flexible connector, said flexible connector passing through a connection point which directs the resistance from the direction of the pivot connecting said lever support means to said frame.

27. The exercise device recited in claim 26, wherein said base includes a bench.

28. The apparatus recited in claim 27, wherein said bench includes a foot retaining means.

29. The exercise device recited in claim 28, wherein said base includes a backrest.

30. The exercise device recited in claim 29, wherein said bench further includes a rolling seat means.

* * * * *

UNITED STATES PATENT AND TRADEMARK OFFICE

CERTIFICATE OF CORRECTION

PATENT NO. : 4,757,993

DATED : Jul. 19, 1988

INVENTOR(S) : Paul L. Rake

It is certified that error appears in the above-identified patent and that said Letters Patent is hereby corrected as shown below: Title page:

following Abstract, "30 Claims, 11 Drawing Sheets", should read — 30 Claims, 10 Drawing Sheets — column 1, line 53, "returning the to starting position", should read, - - returning to the starting position- - column 3, line 50, "positioning menas" should read - - positioning means - - column 12, line 14, "iron 14 of which" should read - - iron 14 each of which - - column 13 line 39, "Pind 16" should read - - Pins 16 - - column 16 line 32, "tot he" should read - - to the - -

Signed and Sealed this

Twenty-first Day of February, 1989

*Attest:*

DONALD J. QUIGG

*Attesting Officer*

*Commissioner of Patents and Trademarks*